106-88 AU 113 EX

7/24/79 XR 4,161,855

United States Patent [19]

Mulvey et al.

[11] 4,161,855

[45] Jul. 24, 1979

[54] THERMAL INSULATION MATERIAL AND PROCESS FOR MAKING THE SAME

[75] Inventors: Robert F. Mulvey, Malvern; Charles E. Crepeau, Centre Square, both of Pa.

[73] Assignee: General Electric Company, Philadelphia, Pa.

[21] Appl. No.: 874,452

[22] Filed: Feb. 2, 1978

Related U.S. Application Data

[62] Division of Ser. No. 678,842, Apr. 21, 1976, abandoned.

[51] Int. Cl.[2] ..... E04B 2/00; E04B 5/00

[52] U.S. Cl. ..... 52/612; 52/806; 52/809; 106/88; 106/111

[58] Field of Search ..... 106/88, 111; 156/42, 156/43; 264/42, 50; 427/402; 52/615, 619, 612, 806, 809

[56] References Cited

U.S. PATENT DOCUMENTS

| | | | |
|---|---|---|---|
| 1,798,609 | 3/1931 | Knowlton | 156/42 |
| 3,775,351 | 11/1973 | Sachs | 106/88 |
| 3,974,024 | 8/1976 | Yano et al. | 106/88 |

*Primary Examiner*—James Poer

*Attorney, Agent, or Firm*—Stephen A. Young

[57] ABSTRACT

An improved material particularly suited for the thermal insulation of building structures such as residential housing and a process for making the same. The material comprises an inorganic, low-density foam with gypsum as the major constiuent.

5 Claims, 6 Drawing Figures

THERMAL INSULATION MATERIAL AND PROCESS FOR MAKING THE SAME

This is a division of application Ser. No. 678,842, filed Apr. 21, 1976, now abandoned.

BACKGROUND OF THE INVENTION

A wide variety of both inorganic and organic materials have been employed for thermal insulation of building structures.

For example, inorganic materials such as fiberglass and so called rock-wool find widespread application in the United States for residential housing.

More recently, organic materials such as polyurethane foam, and styrofoam have been used primarily for other than residential housing applications.

While the prior art materials exhibit varying degrees of effectiveness as thermal insulators, none of the prior art materials has been completely satisfactory from an overall standpoint.

For example, while the organic foams, in general have better thermal insulative properties than fiberglass, the fire retardant and smoke emission characteristics of the organic foams are less than optimum. Indeed, even fiberglass insulation is found to emit large quantities of smoke when exposed to the flame of a propane torch.

Also, the prior art materials are relatively expensive and require raw materials and processing not readily available in many areas of the world. Since the world in general has a shortage of residential housing, this is a decided disadvantage.

Further, the prior art materials are primarily adapted for use in field erected structures and accordingly do not lend themselves to fully advantageous use in industrialized (i.e., factory-assembled) construction.

Accordingly, it is an object of this invention to provide an improved thermal insulation material and a process for making the same.

It is a further object of this invention to provide an improved thermal insulation material suitable for the insulation of building structures such as residential housing.

It is yet another object of this invention to provide a thermal insulation having improved thermal and fire retardant characteristics.

It is still another object of this invention to provide an improved thermal insulation which is less expensive than conventional insulations.

A still further object of this invention is to provide an improved thermal insulation material formed from raw materials which are readily available in most areas of the world and which is particularly suited for industrialized construction.

SUMMARY OF THE INVENTION

Briefly, the improved thermal insulation of the invention comprises a low density inorganic foam material, the major constituent of which is gypsum. The foam insulation of the invention is produced by intimately mixing a water based gypsum slurry with a water based froth of a foaming agent such as sodium lauryl sulfate. The froth provides small stable bubbles of air which upon mixing with the slurry become encapsulated by the slurry mixture. The slurry material then hardens about the bubbles to produce the low density foam insulation of the invention. A variety of additives such as accelerators and retarders are in practice also included in the slurry mixture. In this manner, a fast curing, low density inorganic foam is realized which has significant advantages over prior art thermal insulation materials and which is particularly suited for industrialized housing applications.

REFERENCE TO DRAWINGS

DETAILED DESCRIPTION OF THE INVENTION

Figure 1:
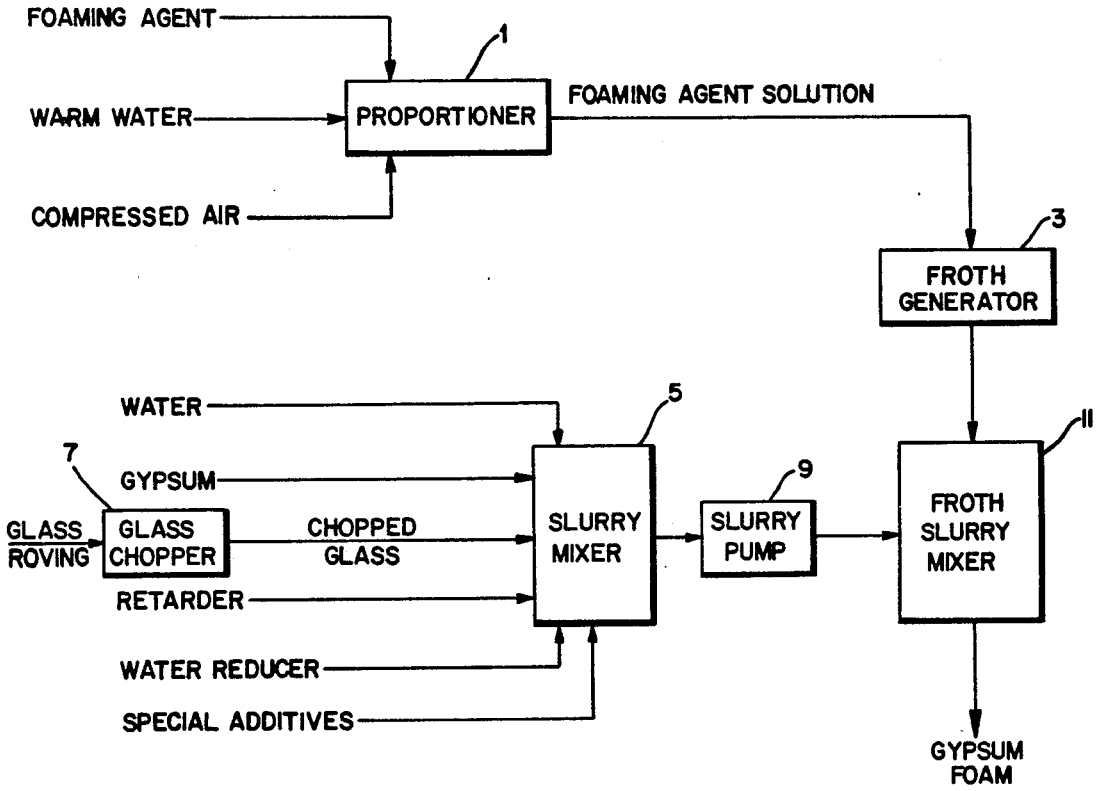
FIG. 1 is a flow diagram of the process for making thermal insulation material in accordance with the invention.

Referring now to FIG. 1, there is shown a simplified flow diagram of the process for producing the low density foam insulation of the invention. The process features two principal streams, a first stream generating a highly stable froth which is combined with a gypsum slurry generated by the second stream to produce the foam insulation of the invention.

As depicted, in the first stream, a foaming agent, preferably a soap, sodium lauryl sulfate solubilized in butyl cellulose and dissolved in water, is applied to a foaming agent proportioner 1. The portioner is also supplied with warm water and compressed air. Small amounts of stabilizers, such as proteins, polyamides or polyols may be added to the foaming agent in order to stabilize the resultant froth. The proportioner 1 serves proportion the foaming agent and water in a predetermined ratio (typically about 4 to about 8% by weight foaming agent), the output of the proportioner being a solution of the foaming agent in water. The solution is then injected into the froth generator 3, the generator 3 serving to convert the solution into a highly stable froth. Depending on the proportion of materials selected, the froth appearing at the output of generator 3 typically has a density between 0.5 to 1.5 pounds per cubic foot.

In the second process stream, water and gypsum are combined in a slurry mixer 5 to produce a gypsum slurry. Chopped glass is also added to the slurry to strengthen the resultant foam insulation, the chopped glass fibers being obtained by the chopping action of glass chopper 7 on conventional fiberglass roving. A variety of known retarders, water reducers and special additives such as accelerators are also in practice added to the slurry mixture.

The output of the mixer 5 which is typically 50% by weight of gypsum is pumped by slurry pump 9 to a froth/slurry mixer 11 where it is intimately mixed with the output of the froth generator 3. The froth from the froth generator 3 provides small stable bubbles of air which upon mixing with the slurry in mixer 11 become encapsulated by the slurry mixture. The froth/slurry mixture typically having a wet density of about 6 to about 8.5 pounds per cubic foot is then removed from the mixer, cast into a mold and allowed to cure to produce the foam insulation of the invention typically having a dry density of about 4 to about 6 pounds per cubic foot.

Readily available commercial equipment may be utilized to perform the process steps depicted in FIG. 1. For example, in practice, the proportioner 1 and froth generator 3 may be an integrated generator of the type widely utilized at airports for foam generation for fire extinguishing purposes. Generally, such a foam generator features a pair of air motor operated pumps the output of which can be independently varied to control the ratio of foaming agent to water. The pumps feed the foaming agent and water to a mixing chamber where the foam (i.e. what I have designated froth) is produced.

Similarly, the slurry mixer 5 may be any suitable tank or container having one or more air motor driven mixing vanes positioned therein. While as pointed out previously dry gypsum may be directly introduced to the slurry mixer 5, it may be advantageous in certain factory applications to inject previously slurried gypsum into the mixer 5. For example, a relatively high density gypsum slurry suitable for this purpose would generally be available from conventional pin mixers in a factory where gypsum wall board, or the equivalent, was being produced.

The glass chopper 7 may be conventional equipment of the type employed to separate fiberglass roving into individual fibers of a desired length. The slurry pump 9 may be of the air operated diaphragm type widely used in commercial processes.

The froth/slurry mixer 11 may be a passive mixer having fixed baffles positioned therein in known fashion, the mixing action resulting from turbulence due to the high shear imparted by the baffles on the slurry and froth streams. Alternatively, the froth and slurry streams might first be applied to a pre-mixer, the partially mixed output of which is then applied to a baffle type mixer of the type just discussed. Such pre-mixer may be of the commercially available expander/mixer type which generally comprises an increased diameter cylindrical mixing chamber at one end of which the streams to be mixed are introduced and at the other end of which the mixed material exits in a single stream. In some application, the expander/mixer may be packed with so-called ceramic "saddles" to enhance the mixing action in known fashion.

Further variations of the process shown in FIG. 1 will occur to those skilled in the art. For example, it may be desirable in some applications to employ a separate expander/mixer of the type just discussed to further mix the froth prior to its mixing with the slurry. Further, since the slurry mixer 5 is most conveniently a batch mixer, it may be necessary to store the slurry mixture in a suitable tank prior to introduction into the froth/slurry mixer 11. Alternatively, more than one slurry mixer 5 may be employed, such mixers alternately supplying slurry to the froth/slurry mixer 11.

The mold into which the wet foam from the froth/slurry mixer 11 is cast may take a variety of forms. In its most simple form this may involve no more than pouring the wet foam onto a casting table having suitable restraining dams to provide foam sheets of desired size and thickness. It may be desirable in any such molding operation to screed the wet foam to insure filling of the mold while removing excess material in known fashion. It may also be desirable to vibrate the mold in known fashion to insure proper filling of the mold.

In another preferred embodiment of my invention, the mold is provided by stuctural elements which become an integral part of a composite wall assembly as depicted most clearly in FIG. 3 and discussed in connection therewith. Alternatively, the mold might be an already existing hollow wall in a previously erected structure to be insulated, the wet foam being injected through a suitable aperture much in the manner in which rock wool is now employed.

The raw materials utilized to practice my invention are readily available in most areas of the world. The strength of the foam of the invention is provided by the gypsum which hardens on the skin of the froth bubbles to form a low density cellular structure. Such gypsum is found as a natural rock deposit in most parts of the world. In the natural state gysum purity ranges from about 80 to 99 percent. Natural gypsum is basically calcium sulphate with two waters of hydration ($CASO_4.2H_2O$). The heating of this gypsum to roughly 400° F. (i.e. so-called calcimining) will remove all but ¾ of the two waters of hydration providing a product designated hemihydrate gypsum ($CASO_4.\frac{1}{2}H_2O$) which is the form that is normally used for making all plaster products. This form is also available as a synthetic by-product of the fertilizer industry. Impurities in the hemihydrate gypsum are found to have a major effect on the material performances. If the hemihydrate gypsum is incompletely calcimined and some of the original dyhydrate gypsum is present the product will cure at a greatly accelerated rate. Impurities from the fertilizer industry in the synthetic gypsum are normally phosphoric acid in the 3% range. This impurity works its way between the gypsum crystals and is extremely difficult to remove by washing. Neutralization with sodium carbonate or similar materials is very effective in removing and neutralizing the impurities. If removed and naturalized the material is quite suitable for use. Some of the fertilizer production processes, with those of Japan being the most highly developed, have been designed to produce a useful high purity gypsum and the neutralization step discussed above is not necessary.

The various gypsums available have a variety of different cure rates and therefore the accelerator/retarder system must be tailored to the material being used. Through the use of a known accelerator such as alum or known retarders such as sodium citrate or in some instances a combination thereof nearly any dihydriate gypsum material can be used to produce the foam of the invention.

Since plaster (i.e. gypsum) is well known to be slightly soluble in water and is also weakened by water (wet plaster has ⅓ the strength of dry plaster) additives can in practice be utilized to minimize such weakening in the event that the foam insulation of the invention were to become wet.

Materials such as emulsified tar and asphlat and emulsified polymers such as polyvinyl chloride, polyvinyl acetate, acrylics and other inexpensive water compatible polymers may be utilized in the formulation as coating agents for the gypsum. Also, reactive systems such as urea and melamine formaldehyde may be utilized. All of these systems are compatible with the foam formulation of the invention.

Additionally, I have discovered that it may be advantageous in some applications to substitute finely powdered lime (i.e. CaOH) for about one quarter to one half by weight of the gypsum, the lime reacting with carbon dioxide in the atmosphere to improve the water resistance characteristics of the cured foam insulation.

Fiberglass is preferably incorporated into the formulation to provide increased resistance to vibration. Fibers are preferably from ½"-2" in length and may be utilized in concentrations ranging from about 0.5% to 3% by weight. The shorter length glass in the lower concentrations is particularly useful in providing vibration resistance required for over the road transportation and may be used advantageously in such applications.

It is known that a variety of readily available water reducing agents such as Ligno Soltinata can often be advantageously employed with gypsum formulations. It is the purpose of such water reducing agents (i.e. wetting agents) to change the thixotropic characteristic of the mixture. In a thixotropic system the wet gypsum mixture is more sensitive to shear and will therefore flow more easily than it would without the wetting agent. In gypsum formulations this means that up to 50% of the water can be eliminated with a corresponding improvement in density. Since the structural strength is proportional to the square of the density of the use of the water reducer agent can greatly improve the strength of the gypsum. However, in the case of the foam of the invention since a low density is desired, a water reducing agent is not particularly useful for this purpose. A water reducing agent can, however, be employed advantageously with the foam of the invention if the drying time available for water removal is short or if an oven drying is required in which event it may be more cost effective to use a wetting agent.

Figure 2:
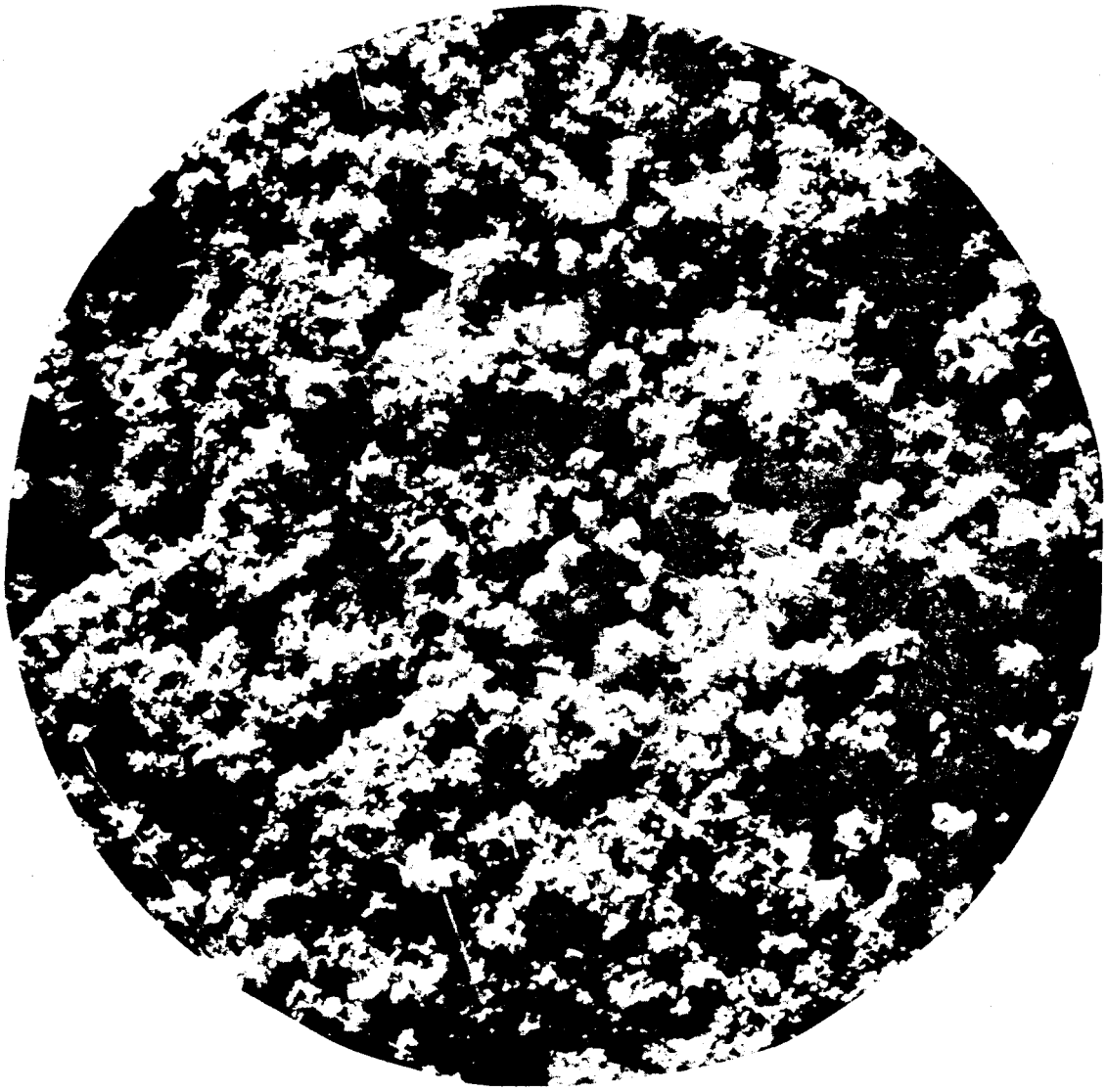
FIG. 2 is a photograph enlarged approximately 12 times of the low-density foam insulation of the invention.

Referring now to FIG. 2 there is shown a photograph of a section of the low density foam of the invention enlarged approximately 12 times. The foam insulation depicted has a density of about five pounds per cubic foot. From the photograph of FIG. 2 the cellular structure of the low density foam insulation of the invention can be readily seen, this structure resulting from the gypsum hardening on the skin of the froth bubbles as previously described. Also in FIG. 2 the chopped fiberglass fibers which are added to the wet mixture to strengthen the resultant foam insulation are seen to be uniformly distributed throughout the sample.

Figure 3:
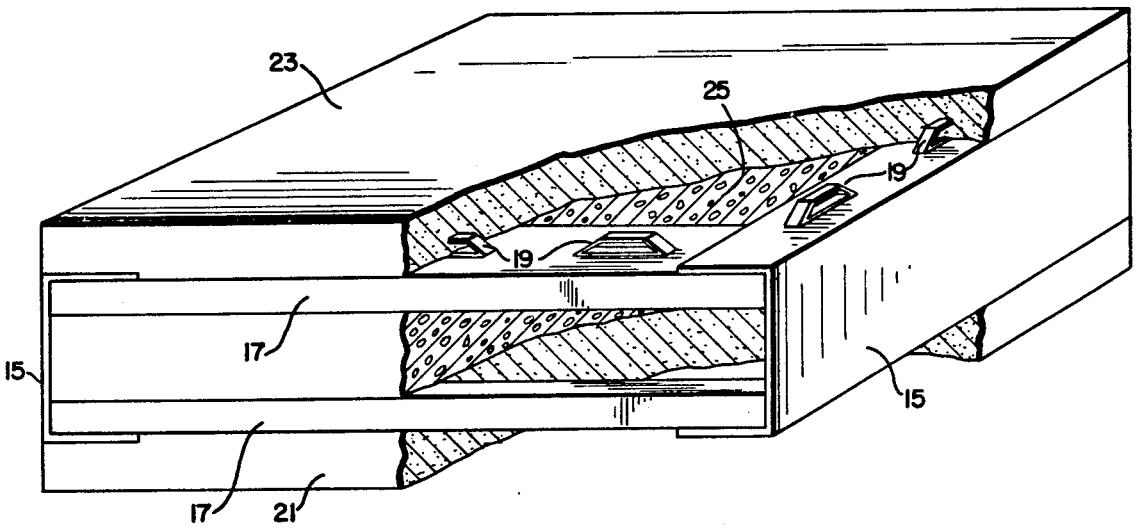
FIG. 3 is a three dimensional cut away view showing a typical structural wall section employing the thermal insulation of the invention.

Referring now to FIG. 3 there is shown a preferred embodiment the foam insulation of the invention as discussed above. As depicted in FIG. 3 structural elements provide the mold into which the foam insulation is cast, the structural elements then becoming integral parts of the resulting composite wall assembly. More specifically, a section of a composite wall assembly is depicted generally at 13. While I have designated this as a "wall assembly" it will be appreciated that such designation is not intended to be limiting and the assembly of FIG. 3 may readily be used in other similar applications such as for example a ceiling.

The assembly 13 comprises a pair of spaced parallel studs 15, between each end of which extend a par of L shaped members 17 to provide a closed rigid frame. The studs and L shaped members are preferably formed from 0.032 inch to 0.48 inch galvanized steel stock spot welded together and including lanced out tabs 19 to engage the associated plaster layers in known fashion.

A first surface layer 21 of the assembly comprises a cast gypsum material having a dry density in the range of about 70 to about 90 pounds per cubic foot. The surface layer 21 is intended as the interior wall of a building structure.

Similarly, a second surface layer 23 may comprise a gypsum material similar to that of layer 21 where the assembly 13 will serve as an interior wall and will not be exposed to the weather. Alternatively, where assembly 13 will serve as an exterior wall and thus will be exposed to the weather, the surface element 13 may be formed from a variety of known cementitions materials or a sheet material such as plywood may be employed.

In accordance with the invention, the space between the surface layers 21 and 23 is filled with the low density foam 25 of the invention to provide an integral wall assembly having superior structural and thermal characteristics.

The assembly of FIG. 3 may be formed by first casting the wet gypsum composition for the surface layer 21 onto a suitable table. The frame comprising studs 15 and members 17 is then partially embedded in the wet gypsum thereby defining a mold into which the wet foam insulation of the invention is cast.

Alternatively, the foam insulation of the invention may be cast on top of the surface layer 21 prior to embedding the frame therein, the frame then being embedded in both the foam insulation 25 and surface element 21 in one operation.

Finally, in the case of an interior wall, irregardless of at which point the frame is embedded, the partially completed assembly is prefereably allowed to cure to a sufficient extent that it may be reversed and be placed on surface layer 23 which is cast in a similar manner to that of surface element 21.

In the case of exterior walls, the surface layer 23 may be applied by a variety of known techniques such as casting of a variety of cementitious materials, spraying of stucco, etc.

Figure 5:
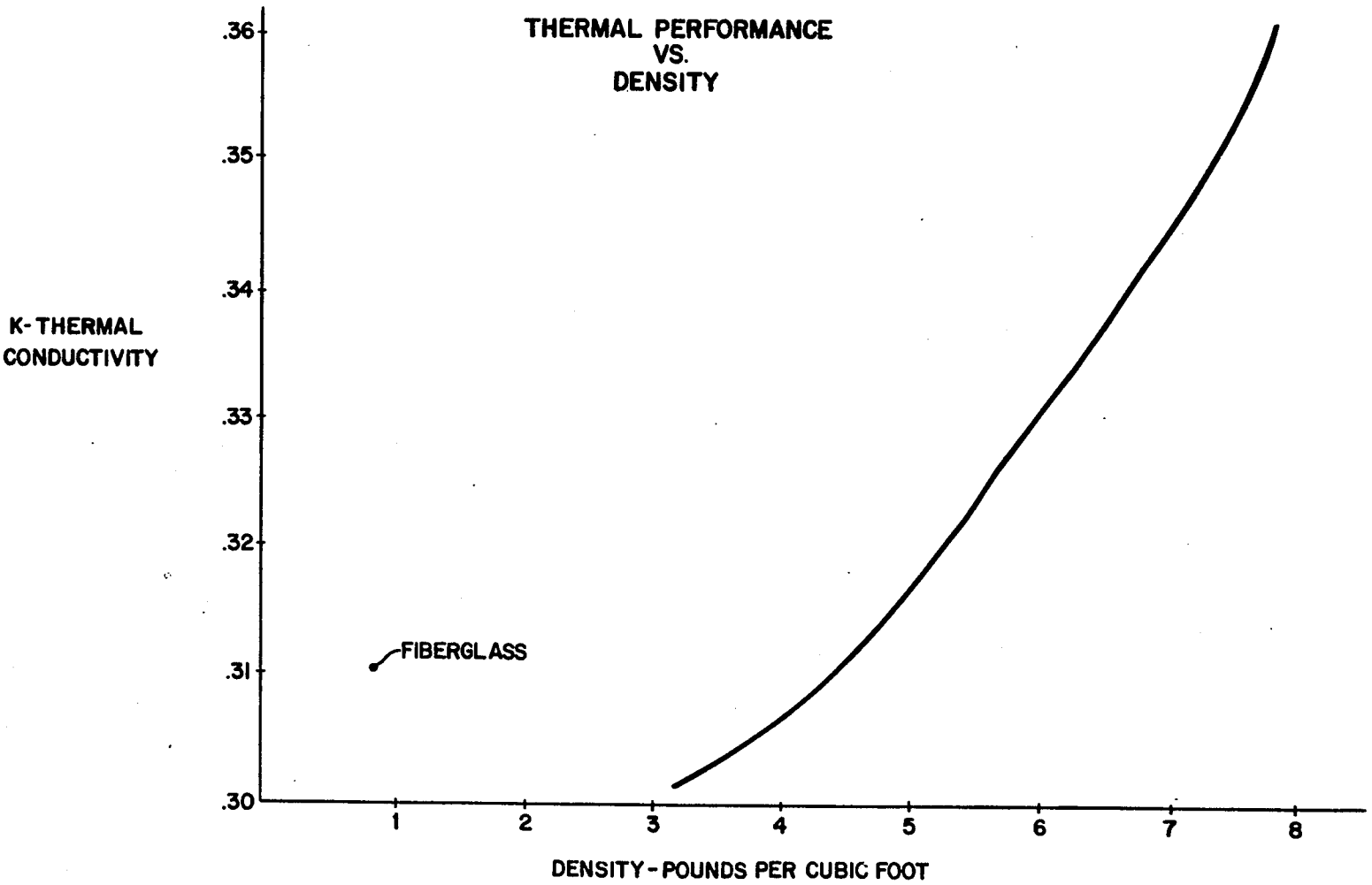
FIG. 5 is a graph showing the thermal coefficient plotted as a function of the dry density of the foam insulation.
Figure 6:
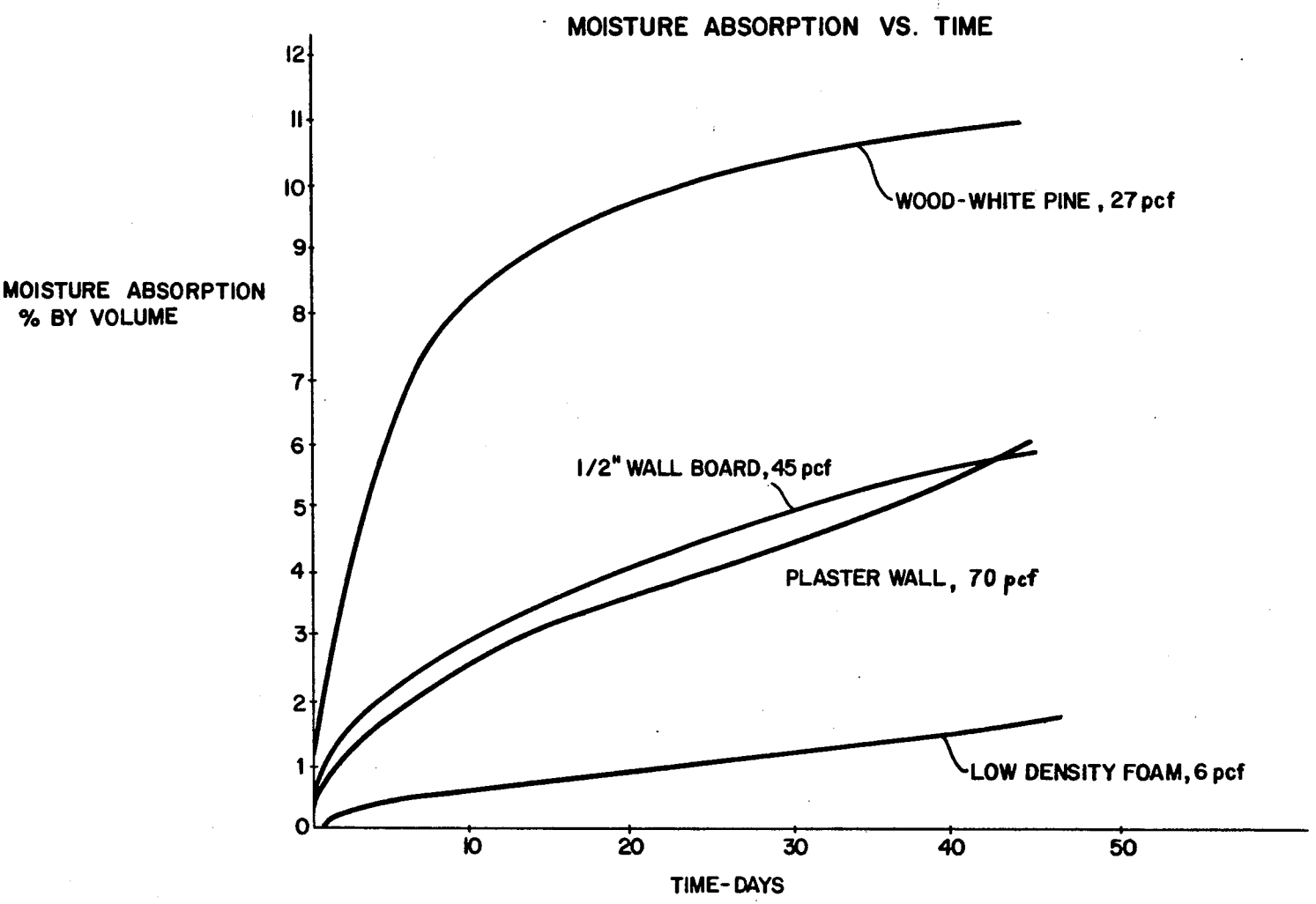
FIG. 6 is a graph depicting the moisture absorption characteristic of a typical foam insulation in accordance with the invention as a function of time and comparing such characteristic to those of other building materials.

As previously pointed out, the low density inorganic foam of the invention finds particular application as thermal insulation in building structures such as residential housing. Improved thermal, fire retardant and smoke emission characteristics are realized from the foam insulation of the invention at a reduced cost compared to conventional materials. The foam insulation of the invention is particularly suited for industrialized construction and is formed from raw materials readily available in most areas of the world. Some representative characteristics of the foam insulation of the invention are shown in FIGS. 4, 5 and 6.

Figure 4:
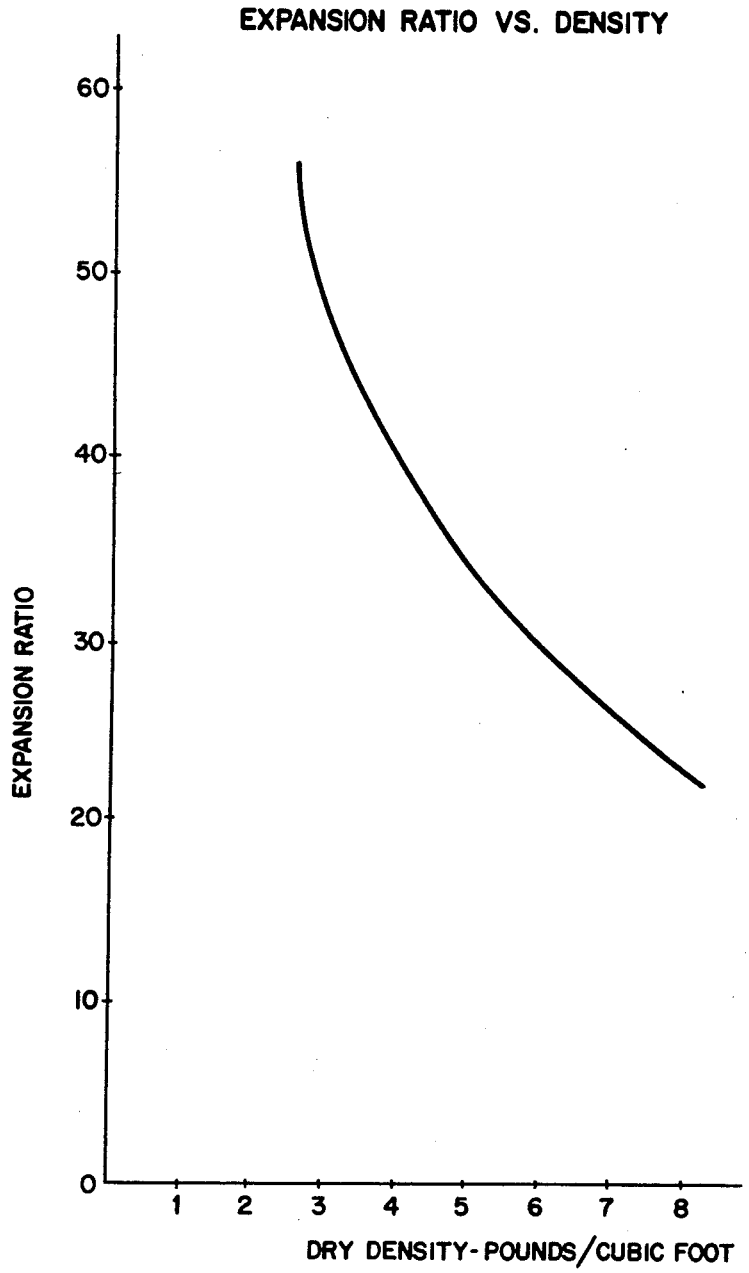
FIG. 4 is a graph depicting the dry density of a typical foam insulation in accordance with the invention as a function of the expansion characteristics of the foam.

Referring now to FIG. 4 there is shown an experimentally derived graph of the dry density of the low density foam of the invention as a function of the expansion rate of the foam.

Expansion ratio is defined as:

$$\text{Expansion Ratio} = \frac{\text{density of water}}{\text{wet density of expanded foam}}$$

Thus expansion ratio as I have defined it is essentially a measurement of the amount of air in the wet foam mixture. In general, the higher the expansion ratio the lower the density of the cured foam insulation. It will be appreciated that the amount of foaming agent which will be required to achieve a desired expansion ratio is directly proportional to the expansion ratio but is inversely proportional to the dry density of the resultant foam. The data for FIG. 4 was derived from a foam sample having a gypsum to froth ratio by weight of 2 to 1 and a gypsum to water ratio by weight of 1 to 1.

FIG. 5 depicts the experimentally derived thermal characteristics of the low density foam of the invention. More specifically the thermal coefficient K is plotted as a function of dry density and is seen to compare favorably with the thermal coefficient of fiberglass insulation even at very low foam densities. Thermal conductivity measurements included in the data of FIG. 5 were obtained by the guarded hot plate method in accordance with ASTM-C177. Referring to FIG. 5, the foam of the invention has a thermal conductivity of less than 0.36 for a dry density of less than 6 pounds per cubic foot.

Referring now to FIG. 6 there is shown the moisture absorption characteristics of the foam of the invention as a function of time and compared to common building materials. The low density foam of the invention which in this case had an initial dry density of 6 pounds per cubic foot is seen to compare favorably to wood and other gypsum products. The data of FIG. 6 was derived at room temperature and 100% relative humidity.

Although, the invention has been described with respect to certain specific embodiments it will be appreciated that modifications and changes may be made by those skilled in the art within the true spirit and scope of the invention. For example, additives in addition to those discussed herein may be added to the low density foam insulation of the invention in order to optimize the characteristics of the foam insulation for a particular application.

What I claim and desire to secure by Letters Patent of the United States is:

1. A thermally insulating composite assembly comprising generally at least one structural surface element and a low density cellular gypsum material positioned adjacent to said surface element, said cellular gypsum material comprising a gypsum matrix having minute cavities homogeneously distributed therein, said gypsum material having a dry density in the range of about 3 to about 6 pounds per cubic foot and a thermal coefficient of less than about 0.36.

2. A composite assembly according to claim 1, wherein said gypsum matrix includes at least approximately 0.5 percent by weight of fibrous material dispersed homogeneously throughout said gypsum matrix.

3. A composite assembly according to claim 2, wherein said fibrous material is comprised of approximately 0.5 to 2 percent by weight of chopped glass.

4. A composite assembly according to claim 1, further comprising at least first and second studs positioned adjacent to said one structural surface element for containing said gypsum material therebetween, whereby to form a thermally insulated ceiling structure.

5. A composite assembly according to claim 1, further comprising a second structural surface element spaced parallel to said one structural surface element to hold said gypsum material therebetween, whereby to form a thermally insulated composite wall assembly.

* * * * *

UNITED STATES PATENT AND TRADEMARK OFFICE

CERTIFICATE OF CORRECTION

PATENT NO. : 4,161,855

DATED : July 24, 1979

INVENTOR(S) : Robert F. Mulvey and Charles E. Crepeau

It is certified that error appears in the above-identified patent and that said Letters Patent are hereby corrected as shown below:

Column 3, line 7, before "to", delete "4", insert therein --3--.

Signed and Sealed this

*Tenth* Day of *June 1980*

[SEAL]

*Attest:*

SIDNEY A. DIAMOND

*Attesting Officer*

*Commissioner of Patents and Trademarks*